US007837068B2

(12) United States Patent
Liberatore

(10) Patent No.: US 7,837,068 B2
(45) Date of Patent: Nov. 23, 2010

(54) DEFORMABLE TUBE WINDING DEVICE

(76) Inventor: Raymond A. Liberatore, 12143 Punkin Hollow Rd., Bentonville, AR (US) 72712

( * ) Notice: Subject to any disclaimer, the term of this patent is extended or adjusted under 35 U.S.C. 154(b) by 0 days.

(21) Appl. No.: 12/045,688

(22) Filed: Mar. 10, 2008

(65) Prior Publication Data

US 2008/0277416 A1 Nov. 13, 2008

Related U.S. Application Data

(63) Continuation of application No. 11/226,175, filed on Sep. 15, 2005, now abandoned.

(51) Int. Cl.
*B65D 35/34* (2006.01)

(52) U.S. Cl. ..... 222/100; D6/541; D9/434

(58) Field of Classification Search ..... 222/95, 222/98–100, 103, 214; D6/541; 24/30.5 R; D9/434

See application file for complete search history.

(56) References Cited

U.S. PATENT DOCUMENTS 1,990,929 A * 2/1935 Bonham ..... 132/314
D150,885 S * 9/1948 Richardson ..... D6/541
2,747,772 A * 5/1956 Ernst ..... 222/100
3,219,238 A * 11/1965 Borkenhagen et al. ..... 222/100
D378,557 S * 3/1997 Tal ..... D6/541
5,685,457 A * 11/1997 Liberatore ..... 222/100
6,247,618 B1 * 6/2001 Liberatore ..... 222/100
D543,751 S 6/2007 Rendzio
D554,985 S 11/2007 Tal
D587,050 S 2/2009 Behan

* cited by examiner

*Primary Examiner*—J. Casimer Jacyna
(74) *Attorney, Agent, or Firm*—Myers Wolin, LLC

(57) ABSTRACT

A squeezable dispenser tube wind-up device, comprising a longitudinally elongated hollow body having opposite, substantially flat exterior sides tapering laterally toward an elongated body inlet at one lateral extremity of the body, the body having an outwardly enlarged, manually grippable, first domed exterior surface at the opposite lateral extremity thereof and merging with said flat sides, the body having opposite ends, the opposite end of the body having an endwise secondarily domed outer surface, for nesting in the palm of the hand of the user, said second domed surface merging with said first domed surface and with said flat tapering exterior sides.

18 Claims, 7 Drawing Sheets

FIG. 7.
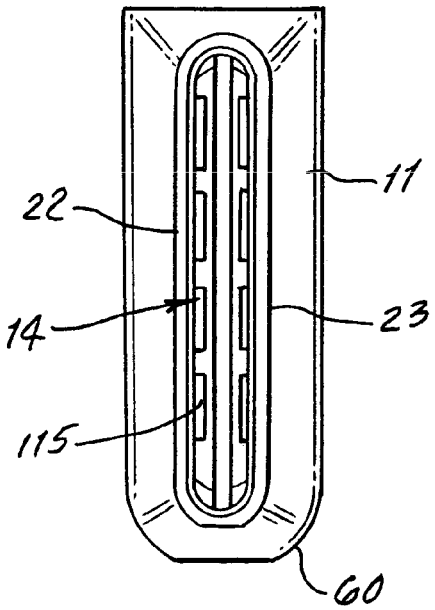
FIG. 8.
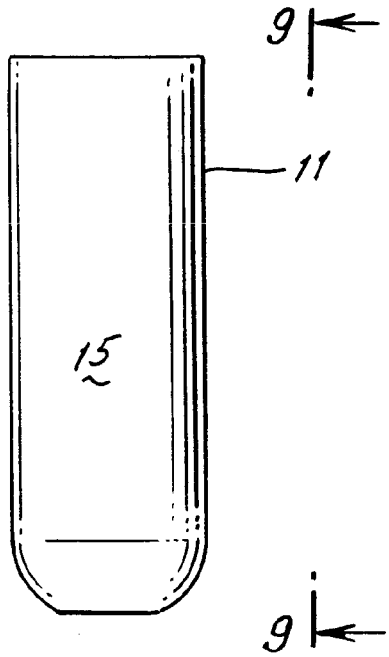
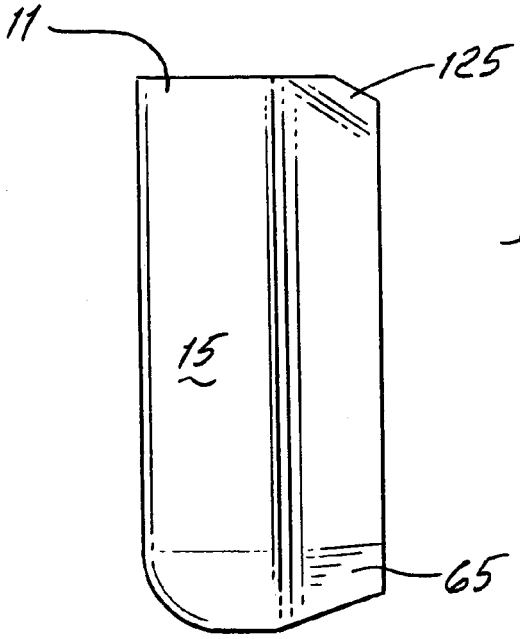
FIG. 9.

FIG. 18.
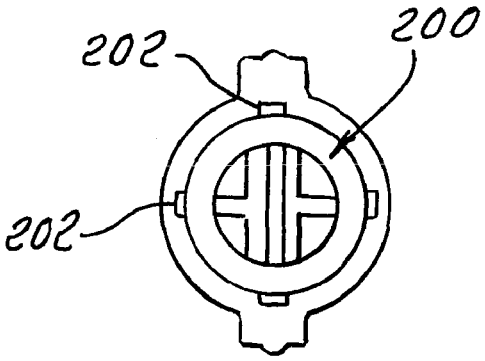
FIG. 19.
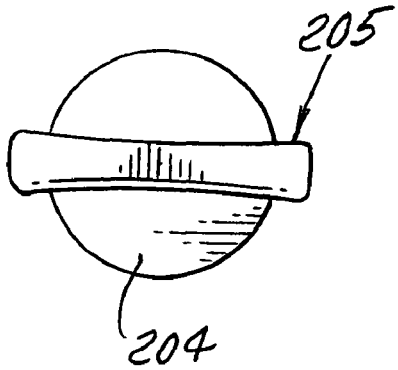
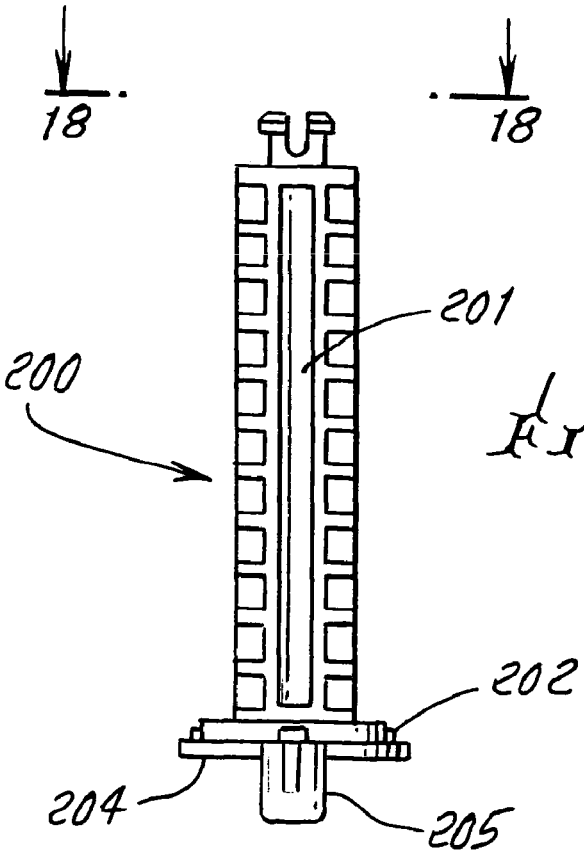
FIG. 17.

DEFORMABLE TUBE WINDING DEVICE

CROSS REFERENCE TO RELATED APPLICATIONS

This is a continuation of U.S. application Ser. No. 11/226,175, filed Sep. 15, 2005, now abandoned, the contents of which are incorporated herein by reference in its entirety.

BACKGROUND OF THE INVENTION

This invention relates generally to devices usable to roll-up containers for products that are dispensable as by container squeezing; and more particularly concerns easily operable toothpaste tube roll-up devices of improved construction and operation.

There is continual need for improvements in devices as referred to, i.e. devices that are more sturdy, more easily handled, more efficient in operation, and less expensive, and also devices having improvements in construction and function, as disclosed herein.

SUMMARY OF THE INVENTION

It is a major object of the invention to provide an improved device to roll-up a squeezable container, such as a toothpaste tube. Basically, the improved device comprises a) a longitudinally elongated hollow body having opposite, substantially flat exterior sides tapering laterally toward an elongated body inlet at one lateral extremity of the body, b) the body having an outwardly enlarged, manually grippable, first domed exterior surface at the opposite lateral extremity thereof and merging with said flat sides, the body having opposite ends, c) the inlet sized to progressively receive and guide a tube closed end portion into the body interior, and there being an elongated dispenser tube reel type gripper in the body interior to grip the tube closed end portion, for rotation and progressive wind-up, d) and a winder at one end of the body and operatively connected with the gripper, for rotating the gripper for winding the tube closed end, and the flattened tube extent within the body interior, e) the opposite end of the body having an endwise second domed outer surface, for nesting in the palm of the hand of the user, that second domed surface merging with the first domed surface and with the flat tapering exterior sides.

Another object is to provide a tube gripper that is longitudinally elongated in the body interior to extend parallel to the elongated inlet, the body defining tube deforming surfaces that taper at the inlet toward the gripper within the body interior, and means supporting the gripper at said second domed end of the body. The gripper may be generally cylindrical, and have an elongated slot therein to receive the end of the tube, the gripper having multiple edges to engage the tube.

A further object is to provide an improved winder that includes an externally protruding, transversely elongated knob, and a carrier for the knob, the carrier and body forming frictionally interfering surfaces to act as a brake to retain the tube in selected wound position, the body having a tapered shoulder extending from a location proximate the carrier to a location proximate an end of said inlet, that shoulder facing the path of rotation of one end of the winder.

Yet another object is to provide an improved carrier that defines a disc extending in a plane normal to an axis of rotation defined by the winder, the knob outstanding from the disc, the frictionally interfering surface of the carrier located proximate the periphery of the disc. The improved knob typically extends parallel to the disc and has opposite ends that extend beyond the disc periphery. Also, a mid-portion of the knob may have a venturi-shaped mid-portion of reduced width, relative to the width of the knob opposite ends. In this regard, each opposite end of the knob may be beveled at opposite sides of the knob for thumb and finger accurate positioning to assist knob rotation.

An additional object is to provide the body slot with opposed walls that taper toward the gripper, and with guide grooves in those walls, that also taper toward the gripper and which are exposed for guiding contact with a deformable tube being wound.

A further object is to provide a recessed end opening in the dome shaped end wall of the, to receive a protuberance on the gripper, for frictional retention of that protuberance. An over center or retention interfit of the protuberance in that opening, allows endwise motion of the gripper in the body, to assist in loosening of the wound tube end from the gripper.

These and other objects and advantages of the invention, as well as the details of an illustrative embodiment, will be more fully understood from the following specification and drawings, in which:

DRAWING DESCRIPTION

FIG. 7 is a side view taken on lines 7-7 of FIG. 6, and showing inlet construction;

FIG. 8 is a view taken on lines 8-8 of FIG. 6;

FIG. 9 is a view taken on lines 9-9 of FIG. 8;

FIG. 17 is a view like FIG. 13 showing a modified gripper;

FIG. 18 is an enlarged end view taken on lines 18-18 of FIG. 17; and FIG. 19 is a view like FIG. 14 showing a modification.

DETAILED DESCRIPTION

Figure 1:
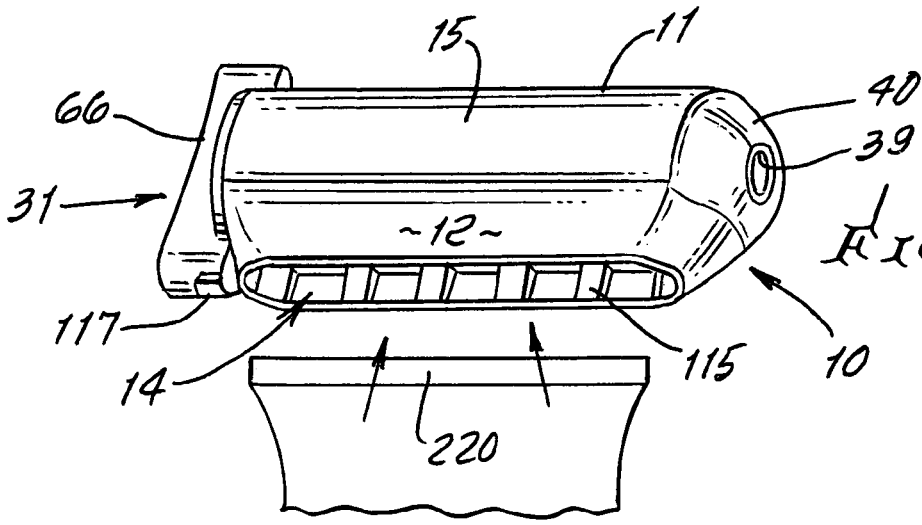
FIG. 1 is a perspective view of a device incorporating the invention.
Figure 2:
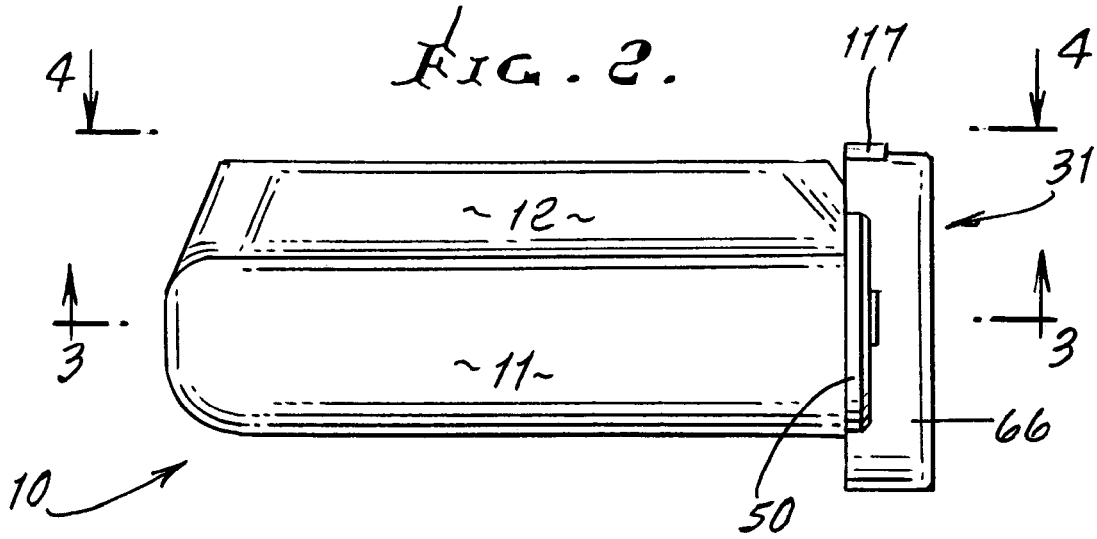
FIG. 2 is a top view of the FIG. 1 device.
Figure 3:
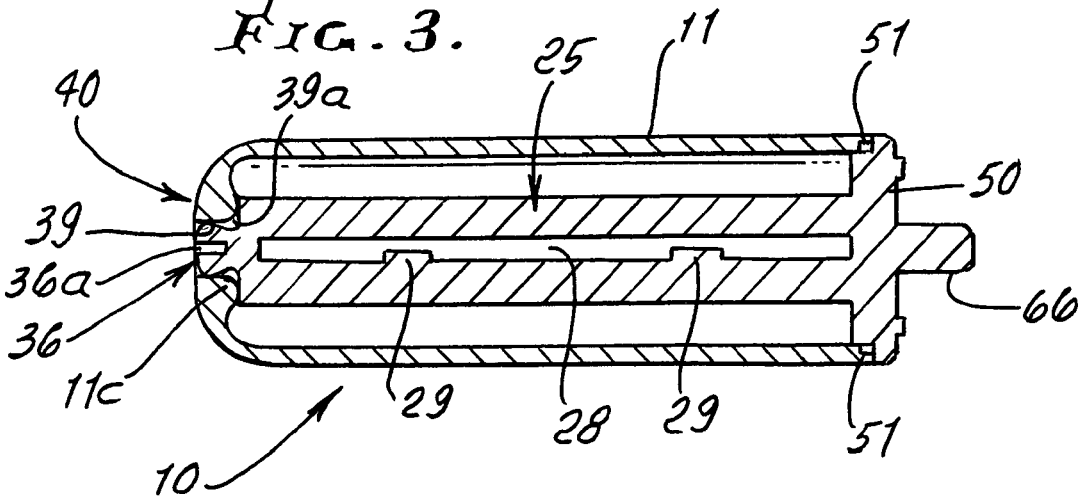
FIG. 3 is a section taken on lines 3-3 of FIG. 2.
Figure 4:
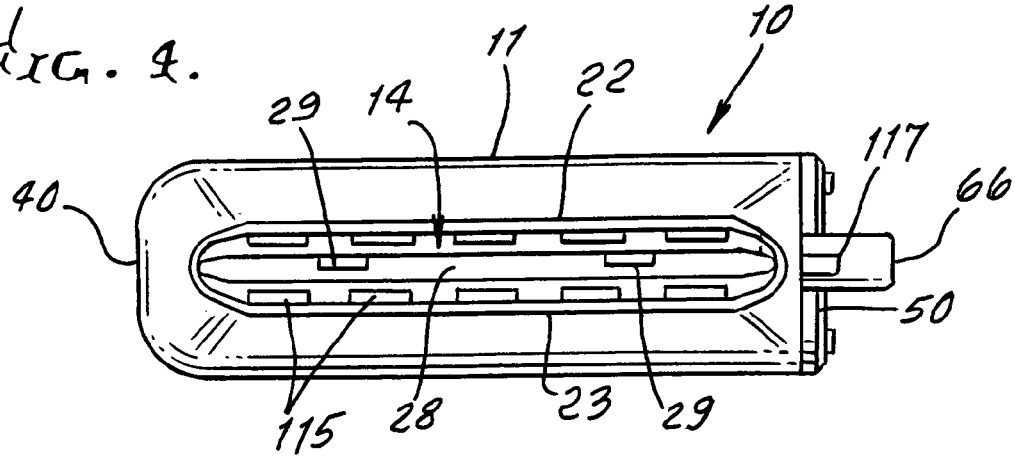
FIG. 4 is a view taken on lines 4-4 of FIG. 2.
Figure 5:
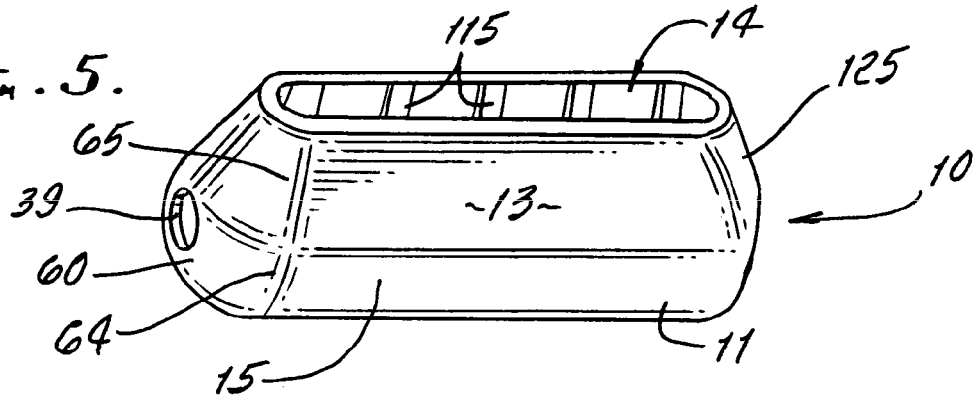
FIG. 5 is another perspective view, showing dual domed construction of the device of FIG. 1.
Figure 6:
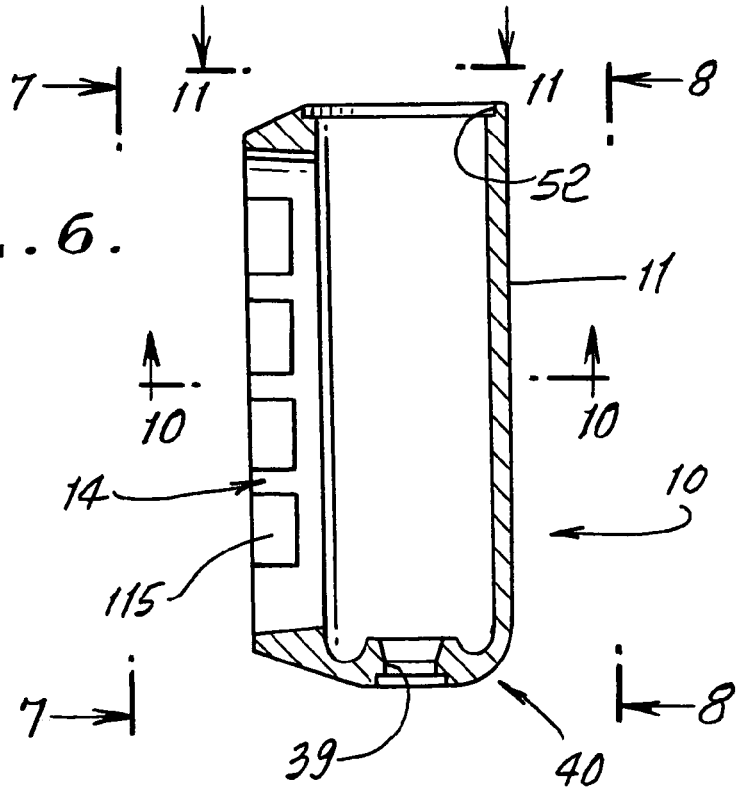
FIG. 6 is a side view of the FIG. 5 device, showing end and top walled domed construction, without the winder assembled to the domed body.
Figure 12:
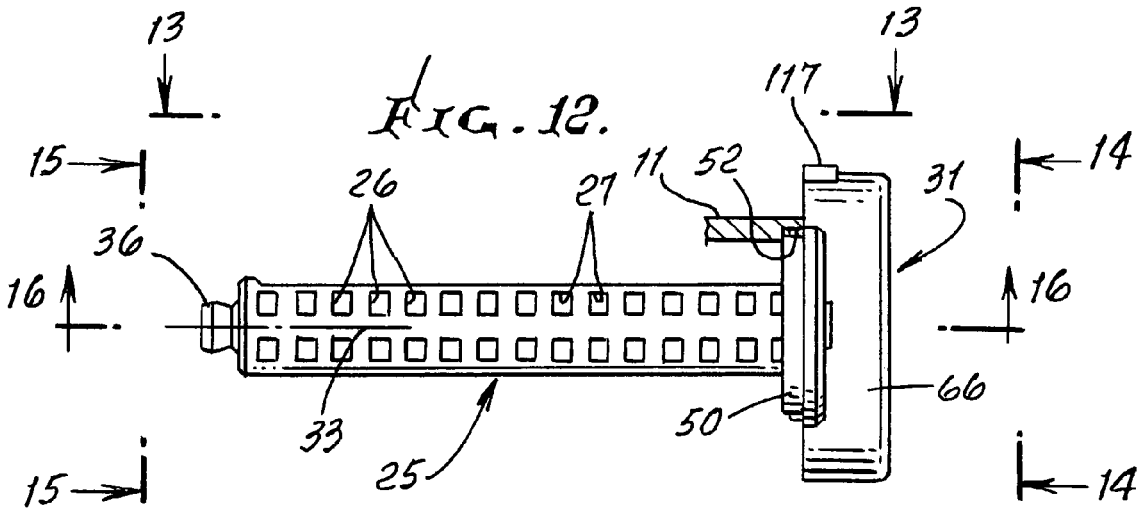
FIG. 12 is a side view of the gripper and winder taken on lines 12-12 of FIG. 11, and the knob end of which is also seen in FIGS. 1-4.
Figure 13:
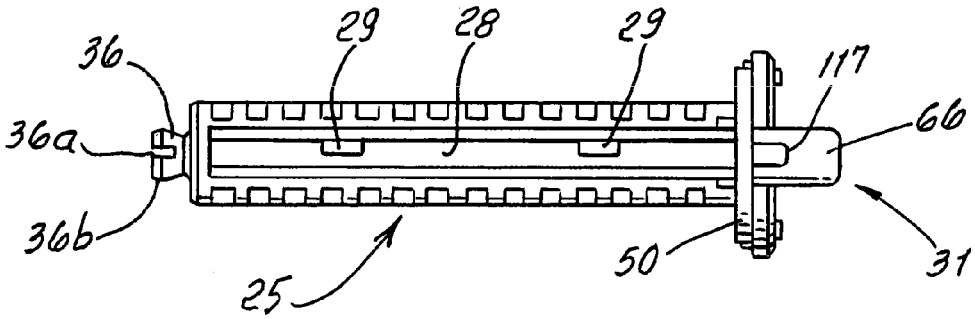
FIG. 13 is a side view taken on lines 13-13 of FIG. 12.
Figure 16:
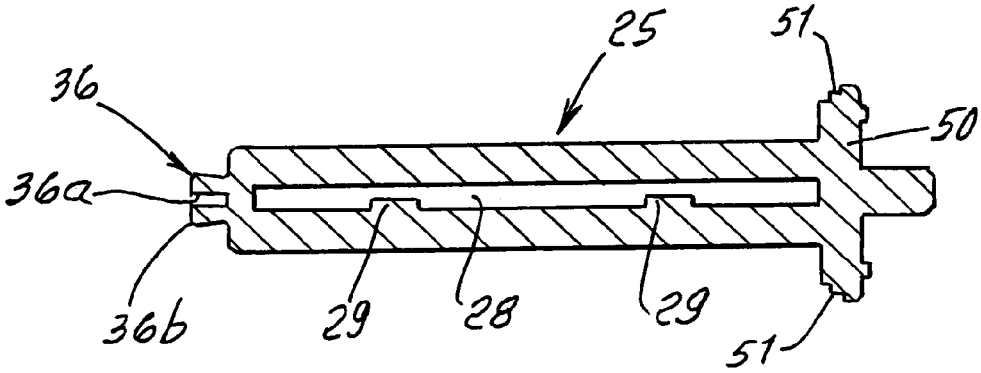
FIG. 16 is a sectional view taken on lines 16-16 of FIG. 12.

In the drawings, a squeezable dispenser (for example toothpaste tube) wind-up device is seen at 10 in FIGS. 1 and 5. It includes:

a) a longitudinally elongated hollow body 11 having opposite, substantially flat exterior sides 12 and 13, which may be alike, and which taper laterally toward a longitudinally elongated slot-like body inlet 14 at one lateral extremity of the body.

b) The body has a outwardly enlarged, easily manually grippable first domed exterior surface 15 at the opposite lateral extremity of the body (i.e. opposite inlet 14). Surface 15 merges convexly with the opposite sides 12 and 13, at regions 16 and 17 seen in FIG. 10. Surface 15 may be a segment of a circle; and the body interior surface 18 may also be circular, for best reception and guiding of a deformable tube (such as a toothpaste tube) 20 spirally wound in interior 21, c) The body inlet 14 is sized, and preferably has tapered inlet walls 22 and 23, to progressively receive and grip a deformable tube (for example and toothpaste tube) closed end portion 220 fed progressively into the body interior, to be wound; and a longitudinally elongated tube gripper 25 is extended longitudinally in the body interior to grip the tube closed end portion, for rotation and progressive wind-up above the gripper. The gripper as seen in FIGS. 12, 13 and 16 may be substantially cylindrical, and have multiple edges 26 as formed by radial slots 27 in the gripper walls and spaced along its length, to enhance guided gripping of the tube. An elongated slot 28 in the gripping receives the closed end of the tube inserted via the inlet. See also teeth 29 projecting into the slot 28, to positively grip the deformable tube end portion, at location spaced about equal distances from the ends of the slot. Such teeth may be omitted.

d) In addition, a winder 31 is provided at one end of the body, and is operatively connected with the gripper, for rotating the gripper about longitudinal axis 33 for winding the tube closed end, inserted into slot 28, as well as the flattened end of the tube, about the gripper. Note that the gripper has a protruding bearing 36 at its end, for reception into an opening 39 in a secondarily domed end 40 of the body 11, to form a bearing for gripper rotation. The opening and bearing 36 may have over-center interfit, for forcibly retaining the gripper in axial position, but with clearances as at 39*a* allowing some endwise play of the gripper, as during unwinding removal of the wound tube from the gripper, helping freeing of the tube end from the gripper. FIGS. 3 and 16 also show that bearing 36 may have a slot 36*a* enabling squeezing together of bearing portions 36*b* to release the bearing from engagement with the bore of body annulus 11*c*, which acts as a frictional retainer. The winder can then be removed endwise. A second bearing is formed by a disc 50 at the opposite end of the gripper, having small protrusions 51 bearing frictionally against the shallow bore 52 in the body to position the gripper and disc axially. See FIGS. 6 and 12. Bearing 36 held in opening 39 retains disc 50 in axial position, yet enables axial displacement of the gripper relative to the body, for assisting in dislodging the tube end from the gripper. In use, the end of the tube may be initially squeezed to provide a tube end portion to be inserted through the entrance slot, and into the winder. The device is then held by one hand, and the winder knob is rotated manually, by the user's other hand. The tube is wound up until the filled portion of the tube engages the body entrance slot. The tube contents are then dispensed, and the winder rotated to wind the tube as needed. When the tube is empty, the knob is turned reversely to unwind the tube, to enable its withdrawal from the device. A new tube is then applied to the device.

e) The opposite end of the body 11 has an endwise secondarily domed outer surface 60 for smooth comfortable nesting in the palm of the hand of the user. Domed surface 60 convexly merges in dual relation with both the first dome surface 15, and with the flat opposite sides 12 and 13 to define a one-piece construction formed by a compound surface defined by surfaces 60, 15, 12 and 13. Domed surface 60 further includes side surfaces that taper inwardly along the transverse axis toward said inlet See also FIG. 5 and convex merger locations 64 and 65.

Figure 15:
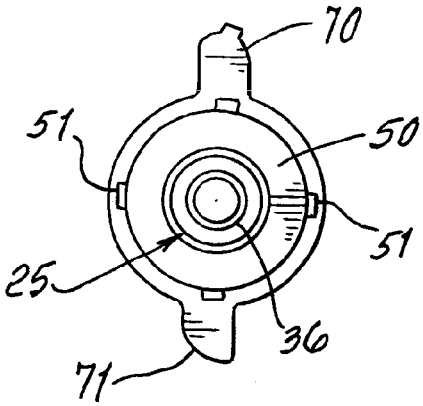
FIG. 15 is an end view taken on lines 15-15 of FIG. 12.
Figure 14:
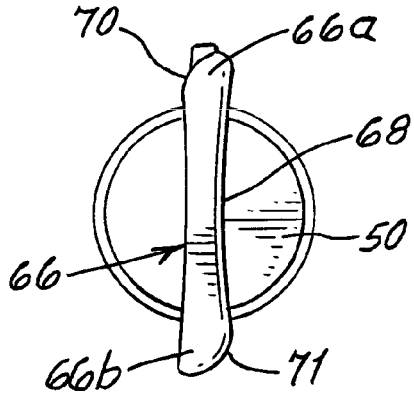
FIG. 14 is an end view taken on lines 14-14 of FIG. 12.

It will also be seen that the winder 31 includes an externally protruding, transversely elongated knob 66, and a carrier for the knob, as represented by disc 50, extending in a plane normal to the axis of rotation defined by the winder. The knob 66 is outstanding from the disc, and extends parallel to the disc. It has opposite ends 66*a* and 66*b* that typically extend transversely beyond the disc periphery, for ready manual gripping. The knob may have a shallow venturi shaped (outwardly concave) mid-portion 68, of reduced width, relative to the widths of the knob opposite ends, for smoothly engaging manual finger and thumb convex surfaces that grip the knob. Opposite ends of the transverse knob may be beveled at opposite sides 70 and 71, seen in FIGS. 14 and 15, for ease of knob rotation, as resisted by the requirement for metallic tube deformation, about the winder.

The body also has a tapered shoulder 125 extending from a location proximate the carrier to a location proximate and end of the inlet. That convex shoulder extends toward the path of rotation of one end of the winder.

Figure 10:
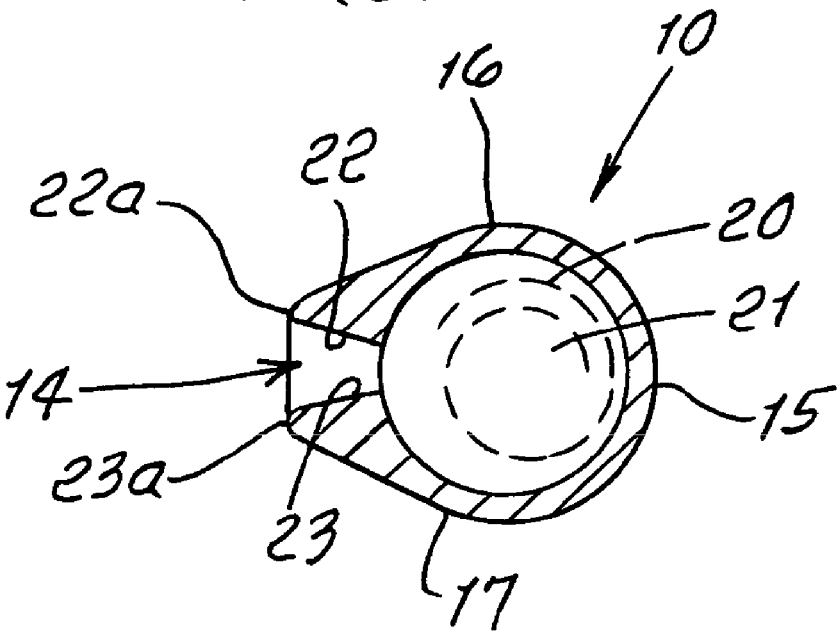
FIG. 10 is a cross section taken on lines 10-10 of FIG. 6, which is taken along a transverse axis device.
Figure 11:
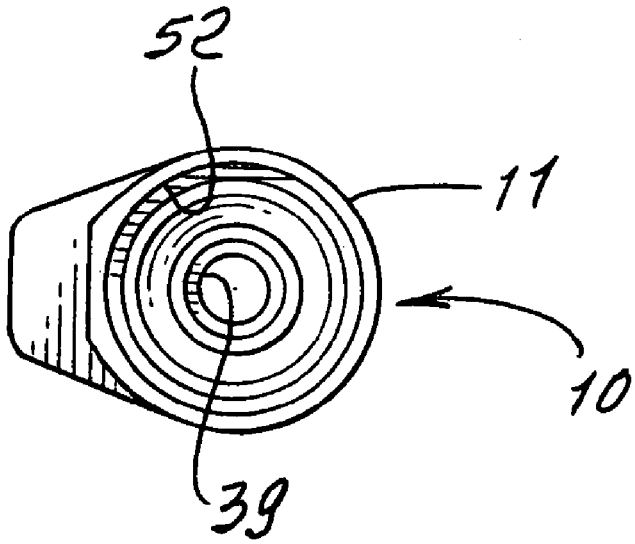
FIG. 11 is a plan view taken on lines 11-11 of FIG. 6.

Additional features which may be included are as follow: In FIG. 10, the body walls 22 and 23 may be rounded at 22*a* and 23*a* to smooth the tube engagement with the walls, at the inlet 14. Also grooves 115 in walls 22 and 23 assist in feeding or guiding of the tube into the inlet. See FIG. 5. Guide or gripper teeth 29 may also be provided on the winder or reel, as referred to above, and as seen in FIGS. 12 and 13. Such teeth and guide grooves may be omitted. Surface regions 16 and 17 of the body taper toward the inlet 14 side of the body, as seen in FIG. 10, and may provide regions for application of indicia, such as lettering.

FIG. 1 shows an indicator 117 on the knob, positioned relative to an element body 11 to indicate when the 28 slot in the winder is aligned with inlet 14, to accept entrance into the slot of the tube end.

Referring to FIG. 17, the modified gripper 200 is similar to the FIG. 13 gripper; however, there are no teeth at the slot region 201 that receives the tube end. FIG. 18 shows a re-usable braking device at 202 on the gripper, and characterized as enabling rotation of the gripper in opposite directions, in the body. FIGS. 17 and 19 show a re-usable knob 204 on the gripper, with a venturi shaped, elongated turning handle 205.

I claim:

1. A squeezable dispenser tube wind-up device, comprising a) a longitudinally elongated hollow body having a transverse axis and opposite, substantially flat exterior sides symmetrically arranged relative to the transverse axis and tapering laterally and converging along the transverse axis toward an elongated body inlet at one lateral extremity of the body, b) the body having an outwardly enlarged, manually grippable, first domed exterior surface at the opposite lateral extremity thereof and merging with said flat sides, the body having opposite ends, c) said inlet formed by the laterally tapering exterior sides and sized to progressively receive and guide a tube closed end portion into the body interior, and there being an elongated dispenser tube gripper in the body interior to grip the tube closed end portion, for rotation and progressive wind-up, d) and a winder at one end of the body and operatively connected with the gripper, for rotating the gripper for winding the tube closed end, and the flattened tube extent extending from said closed end portion, within the body interior, e) the opposite end of the body having an endwise second domed outer surface having side surfaces that taper inwardly along the transverse axis toward said inlet, for nesting in the palm of the hand of the user, said second domed outer surface convexly merging in dual relation with said first domed exterior surface and also with said substantially flat tapering outer sides such that the substantially flat exterior sides, the first domed exterior surface and the second domed outer surface form a one-piece, continuous hollow body, compound outer surface.

2. The device of claim 1 wherein said gripper is longitudinally elongated in the body interior to extend parallel to said elongated inlet, the body defining tube deforming surfaces that are longitudinally elongated and taper at the inlet toward the gripper within the body interior, and means axially frictionally supporting the gripper at said second domed end of the body.

3. The device of claim 2 wherein the gripper is generally cylindrical, and has an elongated slot therein to receive the end of the tube, the gripper having multiple edges to engage the tube.

4. The device of claim 1 wherein the winder further comprises an externally protruding, transversely elongated knob, and a carrier for the knob, the carrier and body forming frictionally interfering surfaces, to act as a brake to retain the tube in selected wound position, the body having a tapered shoulder extending from a location proximate the carrier to a location proximate an end of said inlet, said shoulder extends toward the path of rotation of one end of the winder.

5. The device of claim 4 wherein the carrier defines a disc extending in a plane normal to an axis of rotation defined by the winder, the knob outstanding from the disc, the frictionally interfering surface on the carrier located proximate the periphery of the disc.

6. The device of claim 5 wherein the knob extends parallel to the disc and has opposite ends that extend beyond the disc periphery.

7. The device of claim 6 wherein the knob has a shallow venturi shaped mid-portion of reduced width, relative to the width of the knob opposite ends.

8. The device of claim 6 wherein each opposite end is beveled at a side of the knob for thumb and finger accurate positioning for knob rotation.

9. The device of claim 3, further comprising said dispenser tube, containing toothpaste, the tube having an end portion received in said elongated slot, the tube being deformable.

10. The device of claim 3 wherein the slot has opposed walls that taper toward the gripper, and including guide grooves in said walls, that also taper toward the gripper and which are exposed for guiding contact with a tube being wound.

11. The device of claim 1 wherein said second domed opposite end of the body forms an end opening that is recessed to receive an end protuberance on the gripper, for frictional retention of said protuberance.

12. The device of claim 11 wherein said end opening and said protuberance have over-center interfit permitting endwise manual play of the gripper, to assist in loosening the tube end from the gripper, as well as a tight fit of the gripper to the body, as during roll-up use.

13. The device of claim 12 wherein said end protuberance defines one or more slots enabling squeezing of the protuberance to release it from said frictional retention.

14. The device of claim 1 wherein said body exterior sides have rounded terminals proximate the body inlet, for smooth engagement with the tube exterior during said wind-up.

15. The device of claim 5, further comprising an indicator on the knob to align with structure on the body, to indicate alignment of an elongated tube receiving slot in the gripper with said inlet.

16. The device of claim 1, further comprising a re-usable braking device on the gripper for enabling rotation of the gripper in opposite directions.

17. The device of claim 1, wherein the winder further comprises a transversely elongated knob having opposite ends and an indicator on one of the opposing ends to indicate alignment of an elongated tube receiving slot in the gripper with said inlet.

18. The device of claim 1, wherein the side surfaces of the second domed outer surface are symmetrically arranged relative to the transverse axis.

* * * * *